United States Patent [19]

Jenkins

[11] 4,022,319

[45] May 10, 1977

[54] PACKAGE FOR DISPOSAL OF CHEWING GUM

[76] Inventor: Garry W. Jenkins, P.O. Box 635, Burlington, Vt. 05401

[22] Filed: Apr. 7, 1975

[21] Appl. No.: 565,818

[52] U.S. Cl. ..... 206/233; 206/494; 221/102; 232/43.1

[51] Int. Cl.[2] ..... A45C 11/00; B65D 91/00

[58] Field of Search ..... 206/216, 233, 494, 38 R, 206/464; 312/211, 253, 290; 248/311, 310, 154; 220/18; 221/102, 35, 46; 232/43.2, 43.1

[56] References Cited

UNITED STATES PATENTS

| | | | |
|---|---|---|---|
| 1,915,522 | 6/1933 | Eriksen | 221/102 |
| 2,007,042 | 7/1935 | Duckett | 206/233 |
| 2,434,342 | 1/1948 | Anderson et al. | 221/102 |
| 2,832,498 | 4/1958 | Parsons | 232/43.1 |
| 3,021,948 | 2/1962 | Burge | 206/464 |
| 3,765,565 | 10/1973 | Fietzer | 221/46 |
| 3,845,858 | 11/1974 | Jenkins | 206/233 |

*Primary Examiner*—William T. Dixson, Jr.

[57] ABSTRACT

A combination package for supplying tissue to wrap chewed gum in and to hold the wrapped gum includes a solid or intact wall forming a body casing and an inner partition to separate the casing interior into a tissue supply compartment and a wrapped gum holding compartment; the wall having an opening therein for easy removal of the wrapped gum and a removable closure for said opening. Also, the package may have a large bottom plate providing projecting flanges on which securing means may press.

3 Claims, 6 Drawing Figures

PACKAGE FOR DISPOSAL OF CHEWING GUM

This invention relates to a combination package for holding tissue paper which is to be used to wrap up and enclose chewing gum which the user has chewed and wishes to discard. In addition, the package provides a storage receptacle or container into which the wrapped gum is to be deposited.

The present combination package is an improvement on the basic package which is disclosed and claimed in my U.S. Pat. No. 3,845,858 which issued on Nov. 5, 1974, having the title "Package for Disposal of Chewing Gum". The structures of that patent are hereby incorporated herein by this reference and the novel features of the present invention may be applied to these structures as will be explained.

The package of my patent is quite satisfactory from a utility viewpoint but the present invention involves structural details which simplify its manufacture and, additionally, provide a means for guarding it against theft. Whereas the package of my prior patent is made up of three parts, namely, a bottom, a middle and a top part, the present structure is made up of a body part and a cover. Also, as has been mentioned, the present invention involves a means for fastening the combination package so that it can be removed only with great difficulty.

Representative structures are shown in the accompanying drawings in which.

Figure 1:
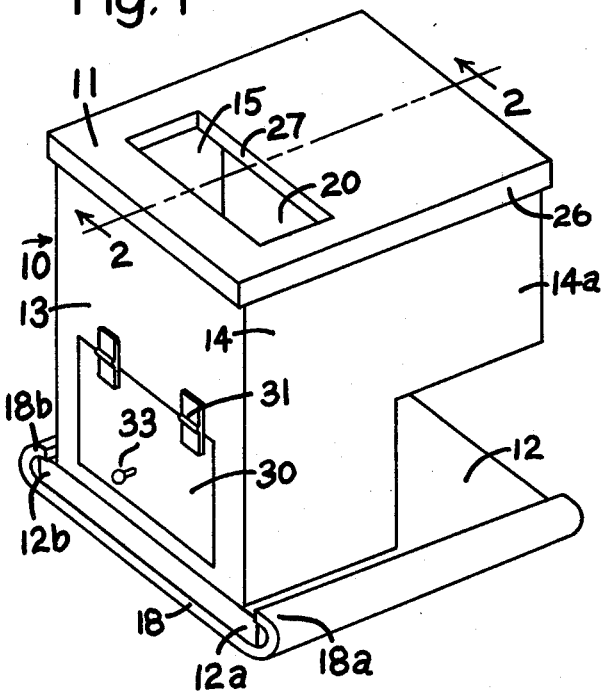
FIG. 1 is a perspective view from a rearward position of one embodiment of the invention.
Figure 2:
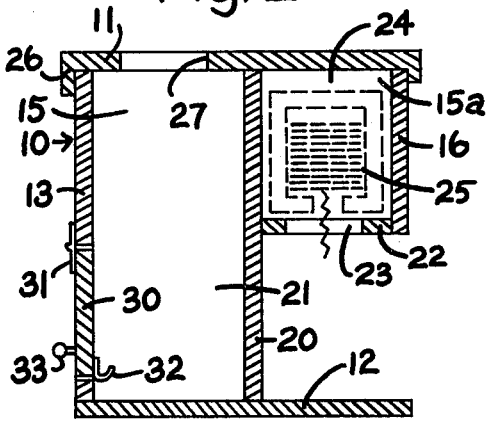
FIG. 2 is a sectional view in elevation on the line 2—2 of FIG. 1, the fastening plate being removed.
Figure 5:
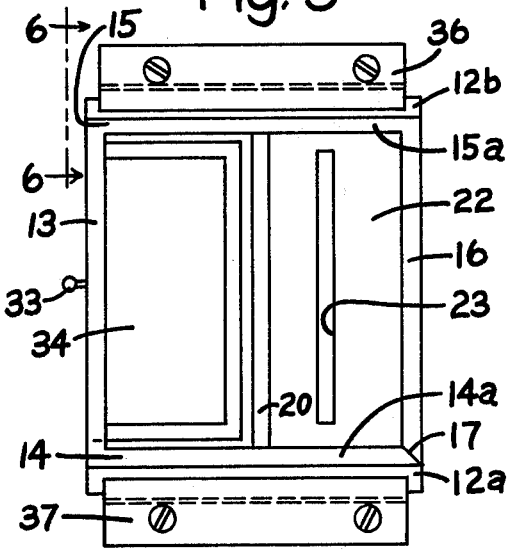
FIG. 5 is a plan view of FIG. 3 with the cover removed and it also shows a modified fastening means and FIG. 6 is a fragmentary elevational view on the line 6—6 of FIG. 5.

Referring first to FIGS. 1 and 2, the combination package of the invention is made up of a box-like body receptacle 10 with a bottom fastening plate 12 and a cover 11. The receptacle 10 includes a vertical rear wall 13, side walls 14 and 15 extending forwardly from its opposite vertical edges and a front wall 16. These four walls may be formed from a single continuous sheet which is bent to form the corners and which is fastened together at the seam 17 as is shown in FIG. 5. Or, the four side walls may be separately cut pieces of sheet metal or other material, their meeting edges being fastened together as at 17.

A suitable material for the side walls is sheet brass as it is easily formed and cut to size and its seam at 17 and like joining places can easily be soldered. However, other materials such as stainless steel or plastics which can be molded to shape or be cemented together, may be employed. The same material may be used for the entire combination package or different materials may be used for the separate parts if it will produce a cheaper or a more attractive package. For instance, the cover 11 could be made of a molded plastic in an attractive design or color and at a low cost, whereas the remainder of the package would be made of a sturdy metal.

It is to be noted that the side walls 14 and 15 are formed or cut to an inverted L shape so that their forward portions 14*a* and 15*a* overhang or overlie the structure. The reason for this will be explained. Also, it is to be noted that the front wall 16, see FIG. 2, is only as high as the forward portions 14*a* and 15*a*.

The four side walls are attached to the base or bottom fastening or attaching plate 12. This may be by solder if the parts are of brass, or by spot welding if the parts are of stainless steel or other metal. This fastening plate 12 extends forwardly to underlie the portions 14*a* and 15*a* of the side walls, to prevent the structure from tipping forwardly. Also, the fastening plate 12 is wider than the receptacle 10 so that it projects beyond the side walls 14 and 15 and forms the side flanges or ledges 12*a* and 12*b*.

These side flanges 12*a* and 12*b* provide ledges which can be used to removably attach the combination package in place. One means of accomplishing this is to provide the securing plate 18 which is to be permanently fastened (not shown) to a table top, a counter top or a like surface where the combination receptacle is to be used. This permanent fastening is not illustrated as it can be by cement, screws, nails or other appropriate means. This securing plate 18 is formed with a upwardly and inwardly overturned edges 18*a* and 18*b* which bear, respectively, on the flanges or ledges 12*a* and 12*b* of the base attaching plate 12.

Figure 4:
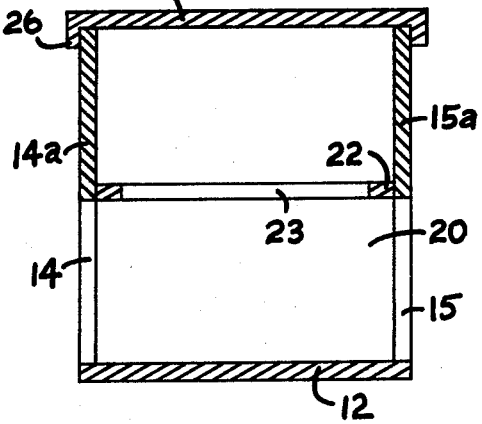
FIG. 4 is a sectional view on the line 4—4 of FIG. 3.

FIG. 1 shows that the flanges 12*a* and 12*b* fit within channels formed by the overturned edges 18*a*, 18*b* of the securing plate 18. This should be a tight fit so that considerable pressure is required to slide the base plate 12 rearwardly or forwardly so that the combination package can be removed for cleaning or sterilizing. This frictional fit will strongly resist displacement or even theft of the combination package as without it a person can freely pick up the entire structure. Of course, the base plate 12 may not be provided with the side flanges 12*a* and 12*b*, as is shown in the modification of FIG. 4.

A vertical partition plate 20 is positioned transversely of the interior of the receptacle 10, extending from side wall 14 to 15. This partition plate 20 is located just where the forward portions 14*a* and 15*a* project frontwardly from their respective side walls 14 and 15. This forms a compartment 21 which is sealed off, except for a top opening, to receive and retain wrapped chewed gum as will be explained.

A horizontal bottom plate 22 is attached to the lower edges of the front wall 16 as well as to the lower edges of the forward portions 14*a* and 15*a* of the side walls. It has a transverse slot 23 therethrough which opens downwardly. Above this bottom plate 22 is a paper supply compartment 24 to retain the paper in which the chewed gum is to be wrapped. This supply of paper 25 is shown in dotted lines as it forms no part of the invention. The paper may be interleaved, individual sheets of tissue paper so that the grasp and withdrawal of the one which is dangling through the slot 23 will enable its procurement and the partial projection of the next tissue through the slot 23.

The cover 11 rests on the top edges of the four side walls and the partition 21 and thereby effectively seals the fres paper 25 in compartment 24 from the waste paper in the compartment 21. This cover 11 preferably has peripheral depending flange 26 which snugly fits on the outside surface of the four outer walls, to hold it in place. Other means to frictionally retain the cover in place are apparent; for instance the flange 26 could press against the inside surfaces of the vertical walls. In this event the depending flange is cut away to receive the top of the partition 20.

A hole or opening 27 is made in the cover 11 to overlie the waste compartment 21. When the structure of this invention is used, a person who has chewed gum, grasps the tissue dangling through the opening 23, wraps the chewed gum in this tissue and drops it through the opening 27.

This discarded, wrapped gum may be emptied from the bottom of waste compartment 21 by inverting the combination package after sliding it out of the securing plate 18 and removing the cover 11. However, to facilitate this trash removal, the invention includes the provision of a door 30 in the lower part of the rear wall 13. This door is hinged at 31 to wall 13 and is releasibly held in closed position by a spring catch 32 fastened to the door.

If the door is opened by the knob 33, the chewed gum in its wrapped tissue may be scooped out of the bottom of the waste compartment 21. This has the advantage of not requiring the removal of the entire assembly from the securing plate 18.

Figure 3:
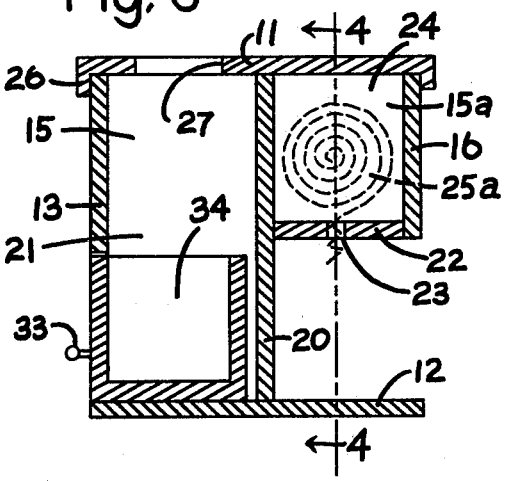
FIG. 3 is a sectional view similar to FIG. 2 but showing a modification.

FIG. 3 shows that the door may be the rear wall of a drawer 34 which can be slid in and out of the door opening. The provision of this drawer eliminates the need to grab the waste material at the bottom of compartment 21. The drawer 34 should practically fill the bottom of compartment 21 so that all of the wrapped gum deposited in opening 27 will fall in the drawer. The drawer eliminates the need for the hinge 31.

FIG. 3 shows a variation of the paper supply as it may be provided in the form of a roll 25*a* as is shown in the dotted lines. Each tissue may be torn off as it is fully withdrawn or the slot 23 may be narrow that it bears slightly on the paper and facilitates the tearing-off step.

As has been stated above, FIG. 4 shows an alternative structure of the bottom plate 12 as it does not have the edge flanges which could fit in the channels of the securing plate. Such a structure is less expensive but it offers a favorable opportunity for theft.

Figure 6:
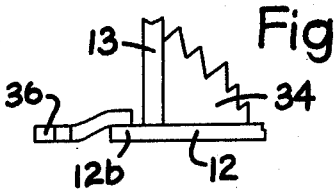

FIGS. 5 and 6 show that instead of the single securing plate 18, the channel-ways to receive the flanges 12*a* and 12*b* may be provided by the two retaining strips 36 and 37 which are to be screwed or otherwise fastened to a table top, for instance. These strips are about as long as the plate 12 and they are offset widthwise as is best shown in FIG. 6 so that when they are fastened down they each form a channelway with the table top to receive the respective flange 12*a* and 12*b*.

The several novel features of the present invention may be applied as well to the structures of my aforementioned U.S. Pat. No. 3,845,858. It will be noted that FIG. 1 of this present application bears a resemblance to the structure if FIG. 1 of my patent. FIGS. 6 and 7 of my patent show modified exterior constructions and those structures may be substituted for the corresponding structure of this present application.

The opening which receives the door 30 or drawer 34 is shown as being in the rear wall 13 but this opening may as well be in one of the side walls. The rear opening is preferred as it is out of sight. It is immaterial whether the tissues are withdrawn through the underside slot 23 or through a front side slot such as 34 in FIG. 7 of my aforesaid patent.

What is claimed is:

1. A combination package for holding tissues in which chewed gum is to be wrapped and also holding gum which has been wrapped in the tissues, which comprises a body casing having an open top and a cover for said casing, said casing comprising a bottom plate, a rear wall and opposing side walls which extend from the bottom plate to the top of the casing, a front wall and a transverse partition plate which extends from side wall to side wall and from the bottom plate up to the top of the casing so that it completely divides the interior in a rear compartment for holding wrapped chewed gum and a front compartment for holding fresh wrapping tissue, the wall of the front compartment having a slot therethrough for the withdrawal of fresh tissue, said cover having an opening above the rear compartment for dropping wrapped gum in the rear compartment, said rear compartment having a lower opening to the exterior through its wall for the removal of wrapped gum from the rear compartment and a movable closure for said opening in the wall.

2. The package of claim 1 in which said movable closure is a door.

3. The package of claim 1 in which said movable closure is a rear wall of a drawer which is insertable in the rear compartment.

* * * * *